US005786742A

United States Patent [19]

Yin

[11] Patent Number: 5,786,742

[45] Date of Patent: Jul. 28, 1998

[54] PUSH BUTTON SWITCH WITH OVERRIDE INTERRUPTION STRUCTURE

[76] Inventor: Tien-Ning Yin, 2F-1, No.19, Lane 100, Hopien N. St., Sanchung Ciiy, Taipei Hsien, Taiwan

[21] Appl. No.: 891,733

[22] Filed: Jul. 14, 1997

[51] Int. Cl.[6] ..... H01H 71/16

[52] U.S. Cl. ..... 337/66; 337/347; 337/68

[58] Field of Search ..... 337/347, 531, 337/66, 67, 68, 64, 70, 75, 76, 69, 74, 140, 113, 414

[56] References Cited

U.S. PATENT DOCUMENTS 4,704,594 11/1987 Krasser ..... 337/66

5,262,748 11/1993 Tsung-Mou ..... 337/66

*Primary Examiner*—Leo P. Picard

*Assistant Examiner*—Anatoly Vortman

*Attorney, Agent, or Firm*—Bacon & Thomas

[57] ABSTRACT

A push button switch with override interruption structure, including a push button, a switch box, a front cover, a base, a support rod, an electric contact and an override interruption structure. The support rod is disposed under the bottom of the push button and the electric contact is fitted with the support rod, whereby by means of depressing the push button, the electric contact is moved downward to close a circuit. The override interruption structure includes a shaft seat disposed with an L-shaped resilient restricting cantilever having a projection. The override interruption structure further includes a power cutting member formed with a chamber at lower end facing the restricting cantilever. In the case of override, the bimetal blade is thermally deformed to act on the restricting cantilever, making the projection thereof disengaged from the chamber of the power cutting member, whereby the power cutting member is moved upward along with the push button by the restoring force into a power cut state.

10 Claims, 5 Drawing Sheets

PUSH BUTTON SWITCH WITH OVERRIDE INTERRUPTION STRUCTURE

BACKGROUND OF THE INVENTION

The present invention relates to a push button switch with override interruption structure having a power cutting member. Ip the case of override, the power cutting member releases the push button from engagement, permitting the push button to be resiliently upward restored to its home position so as to cut off the power. The push button switch ensures safety and is manufactured with simple structure at low cost.

With respect to conventional push button switch, in the case of override, a fuse will be burned down to cut off the power so as to avoid danger. After burned down, the fuse must be replaced by a new one. This procedure is time-consuming and troublesome.

SUMMARY OF THE INVENTION

It is a primary object of the present invention to provide a push button switch with override interruption structure having a bimetal blade and a power cutting member. In the case of override, the bimetal blade is thermally deformed to abut against an L-shaped restricting cantilever, making the power cutting member release the push button from engagement, permitting the push button to be resiliently upward restored to its home position so as to cut off the power.

According to the above object, the push button switch includes a push button, a switch box, a front cover, a base, a support rod, an electric contact and an override interruption structure. The support rod is disposed under the bottom of the push button and the electric contact is fitted with the support rod, whereby by means of depressing the push button, the electric contact is moved downward to close a circuit. The override interruption structure includes a shaft seat disposed with an L-shaped resilient restricting cantilever having a projection. The override interruption structure further includes a power cutting member formed with a chamber at lower end facing the restricting cantilever. In the case of override, the bimetal blade is thermally deformed to act on the restricting cantilever, making the projection thereof disengaged from the chamber of the power cutting member, whereby the power cutting member is moved upward along with the push button by the restoring force into a power cut state.

The present invention can be best understood through the following description and accompanying drawings, wherein:

DETAILED DESCRIPTION OF THE PREFERRED EMBODIMENTS

Figure 1:
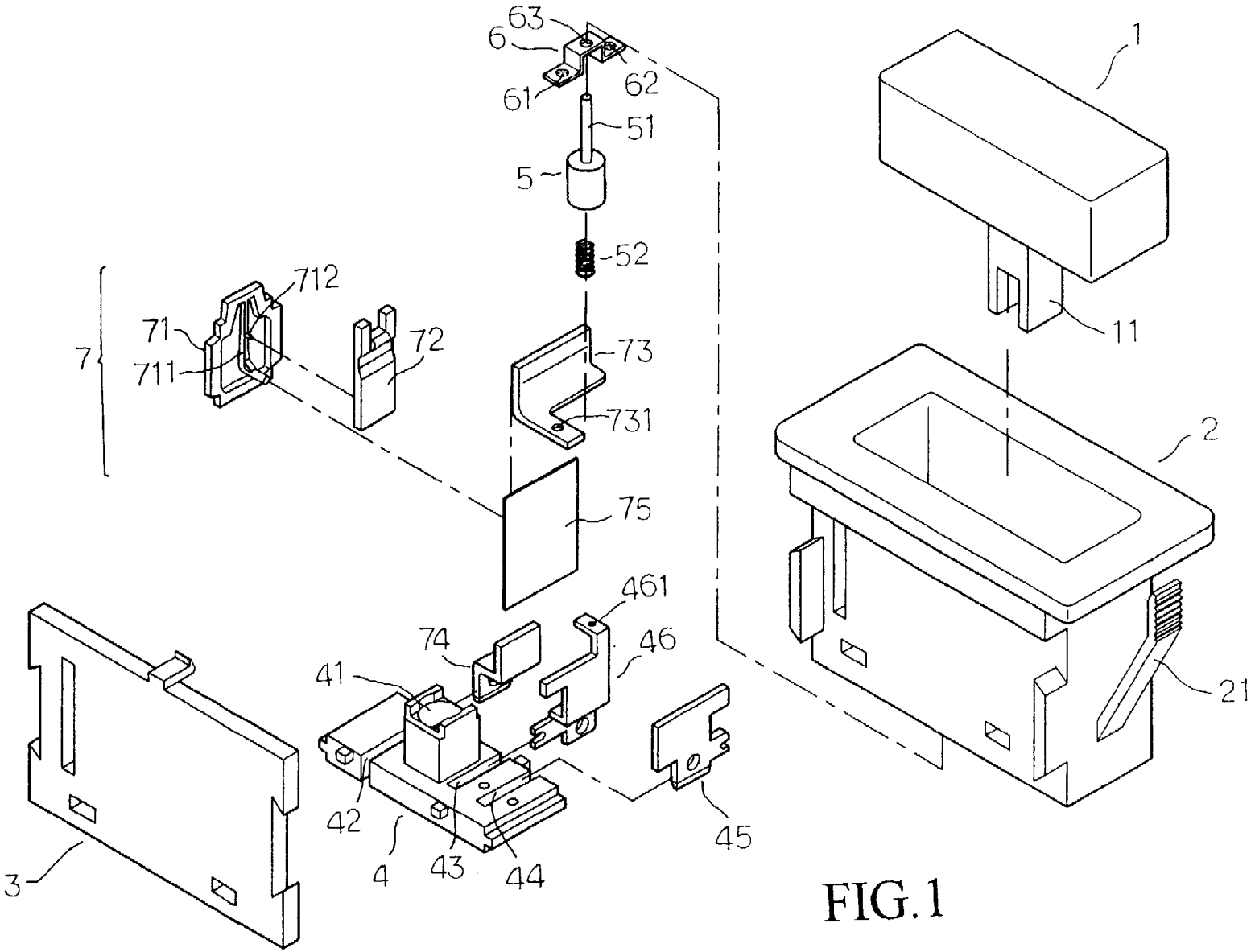
FIG. 1 is a perspective exploded view of a first embodiment of the present invention.
Figure 2:
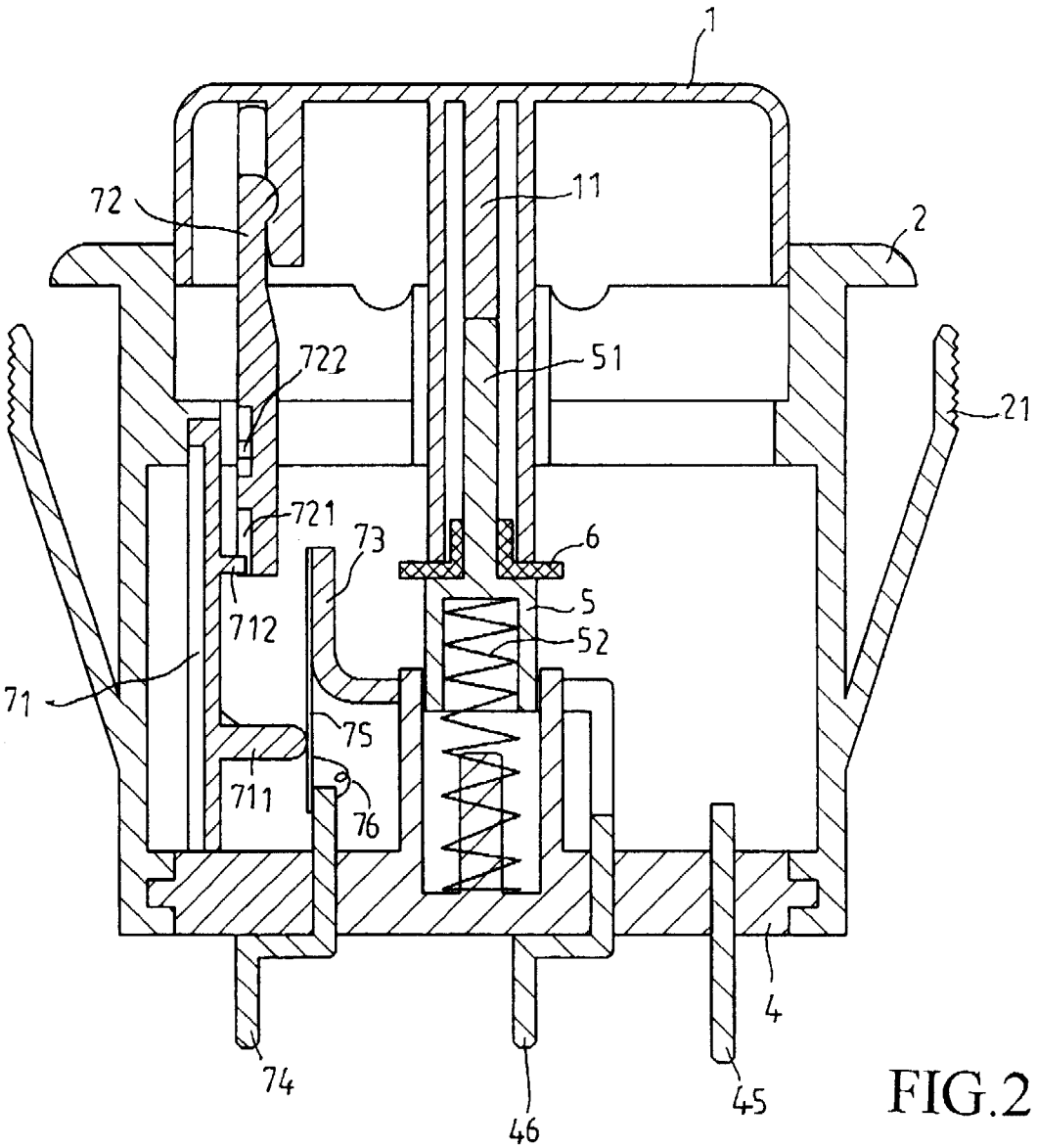
FIG. 2 is a sectional assembled view of the first embodiment of the present invention.

Please refer to FIGS. 1 and 2. The present invention mainly includes a push button 1, a switch box 2, a front cover 3, a base 4, a support rod 5, an electric contact 6 and an override interruption structure 7. The push button is disposed at upper end of the switch box 2 and formed with a pressing projection 11 at the bottom. The front cover 3 is disposed on front side of the switch box 2. Two engaging members 21 are respectively disposed on two lateral sides of the switch box 2 for locating the switch box 2 in an electric appliance. The base 4 is installed on the bottom of the switch box 2 and formed with a receptacle 41 and insertion channels 42, 43, 44 for inserting conducting plates 74, 45 and second conducting board 46. The second conducting board 46 is disposed with a second contact point 461. The upper end of the support rod 5 is disposed with a rod section 51 for abutting against a lower end of the pressing projection 11 of the push button 1. The lower end of the support rod 5 is formed with a hollow section for fitting into the receptacle 41. A restoring spring 52 is axially disposed between the hollow section of the support rod 5 and the receptacle 41 for upward restoring the Push button 1 after depressed. The electric contact 6 is disposed with a fitting hole 63 and two contact points 61, 62 on two sides. The electric contact 6 is fitted around the rod section 51 and positioned between the lower end of the pressing projection 11 and the support rod 5. When depressing the button 1, the electric contact 6 is moved downward, whereby the contact points 61, 62 contact with the first and second contact points 731, 461 of the first and second conducting boards 73, 46, permitting the current to pass therethrough. The override interruption structure 7 includes a shaft seat 71, a power cutting member 72, a first conducting board 73, conducting plate 74, bimetal blade 75 and conducting wire 76. The first conducting board 73 is disposed with a first contact point 731 and the bimetal blade 75 is directly fixed on one side thereof by riveting or welding. The other end of the bimetal blade 75 is a free end contacting with the conducting plate 74 and connected with a conducting plate 74 of the base 4 via a conducting wire 76, whereby in case the bimetal blade 75 cannot restore to its home position to contact with the conducting plate 74 after deformed, the conducting wire 76 still can close the circuit. An L-shaped restricting cantilever 711 is disposed in the shaft seat 71 and is disposed with a projection 712. The lower end of the power cutting member 72 is formed with a cavity 721 facing the restricting cantilever 711 for receiving the projection 712 in a power cut state. A stepped chamber 722 is formed above the cavity 721, whereby when the push button 1 is depressed, the projection 712 is guided into the chamber 722 and temporarily engaged therewith to maintain the conducting state. When the push button 1 is secondarily depressed, the projection 712 is moved out toward the cavity 721, whereby the push button 1 can be moved upward to the respective contact points to cut off the power. Also, when the projection 712 is restricted within the chamber 722, in case the bimetal blade 75 is subject to override and thermally deformed to act on the restricting cantilever 711 and make the restricting cantilever 711 outward biased, the projection 712 is gradually moved outward to disengage from the chamber 722. At this time, the power cutting member 72 is resiliently shifted due to the upward restoring force exerted by the restoring spring 52 onto the push button 1. The electric contact 6 is driven by the support rod 5 and moved upward along with power cutting member 72 to cut off the power.

Figure 3A:
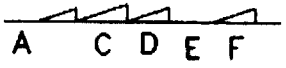
FIG. 3A shows the height of the respective points of the chamber of the power cutting member of FIG. 3.
Figure 3:
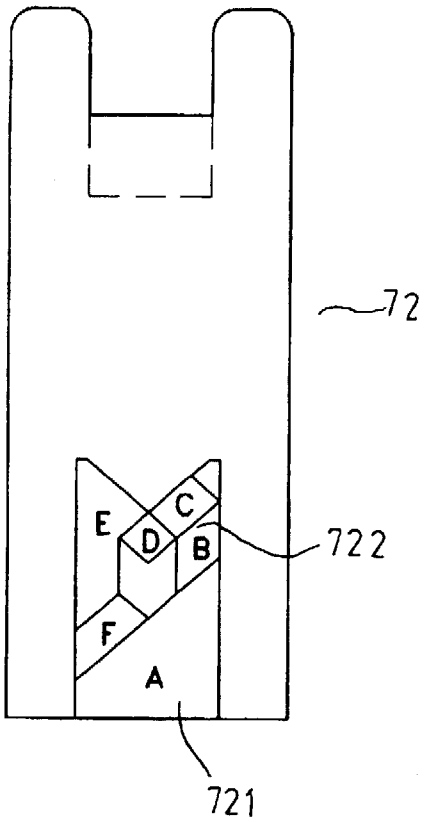
FIG. 3 is a front view of the power cutting member of the override interruption structure of the present invention.

Referring to FIGS. 3 and 3A, area A indicates the shape and height of the cavity 721, while areas B, C, D, E, F indicate the internal shapes and heights of the chamber 722. When the projection 712 abuts against the same, the projection 712 is moved in the sequence of A-B-C-D-E-F-A, whereby the power cutting member 72 is shifted by the resilient force of the push button 1 itself to cut off the power or downward pushed to restore to the initial state.

Figure 4:
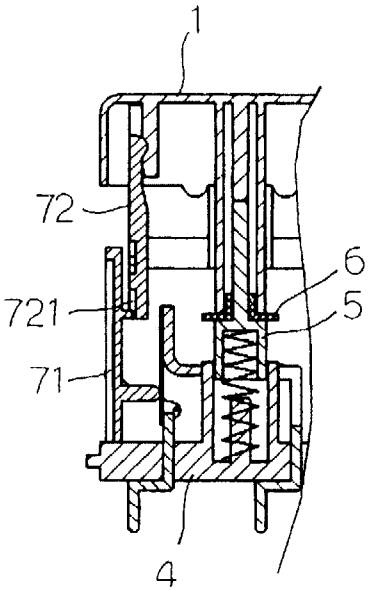
FIG. 4 shows the initial power cut state of the present invention.
Figure 5:
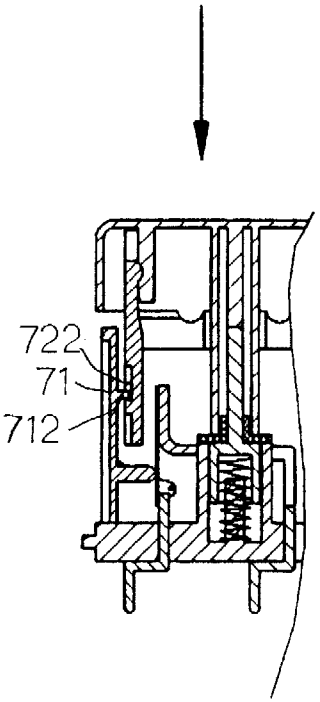
FIG. 5 shows the operation of the present invention in a power on state.
Figure 6:
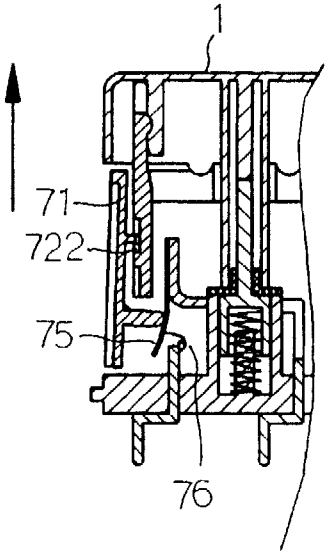
FIG. 6 shows that the bimetal blade is thermally deformed due to override.
Figure 7:
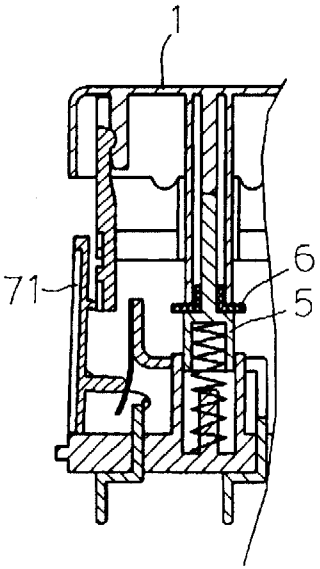
FIG. 7 shows that the Push button is upward restored to its home position.
Figure 8:
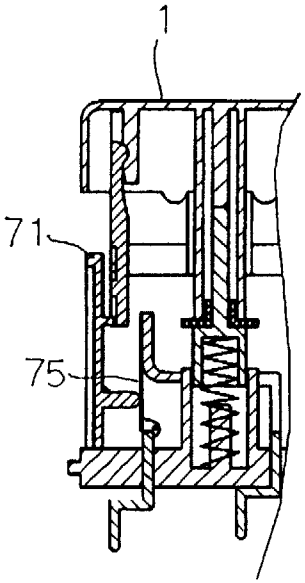
FIG. 8 shows that the components of the present invention are restored to the initial state.

FIGS. 4 to 8 show the use of the present invention, wherein FIG. 4 shows the initial power off state. When closing the circuit, the push button 1 (referring to FIG. 5) is depressed to make the electric contact 6 move downward to contact with the first and second conducting boards 73, 46 and close the circuit. Also, the projection 712 of the shaft seat 71 is moved upward from the cavity 721 to the chamber 722 when the power cutting member 72 is moved downward. Referring to FIG. 6, when the current passes through the circuit, the bimetal blade 75 is thermally deformed due to override to abut against and outward bias the restricting cantilever 711. The projection 712 is also outward biased to disengage from the cavity 722 of the power cutting member 72. Therefore, the power cutting member 72 is upward moved by the restoring force of the restoring spring 52 into a power cut state. When the bimetal blade 75 is gradually cooled and restored to its home position, the shaft seat 71 is also restored to its home position.

Figure 9:
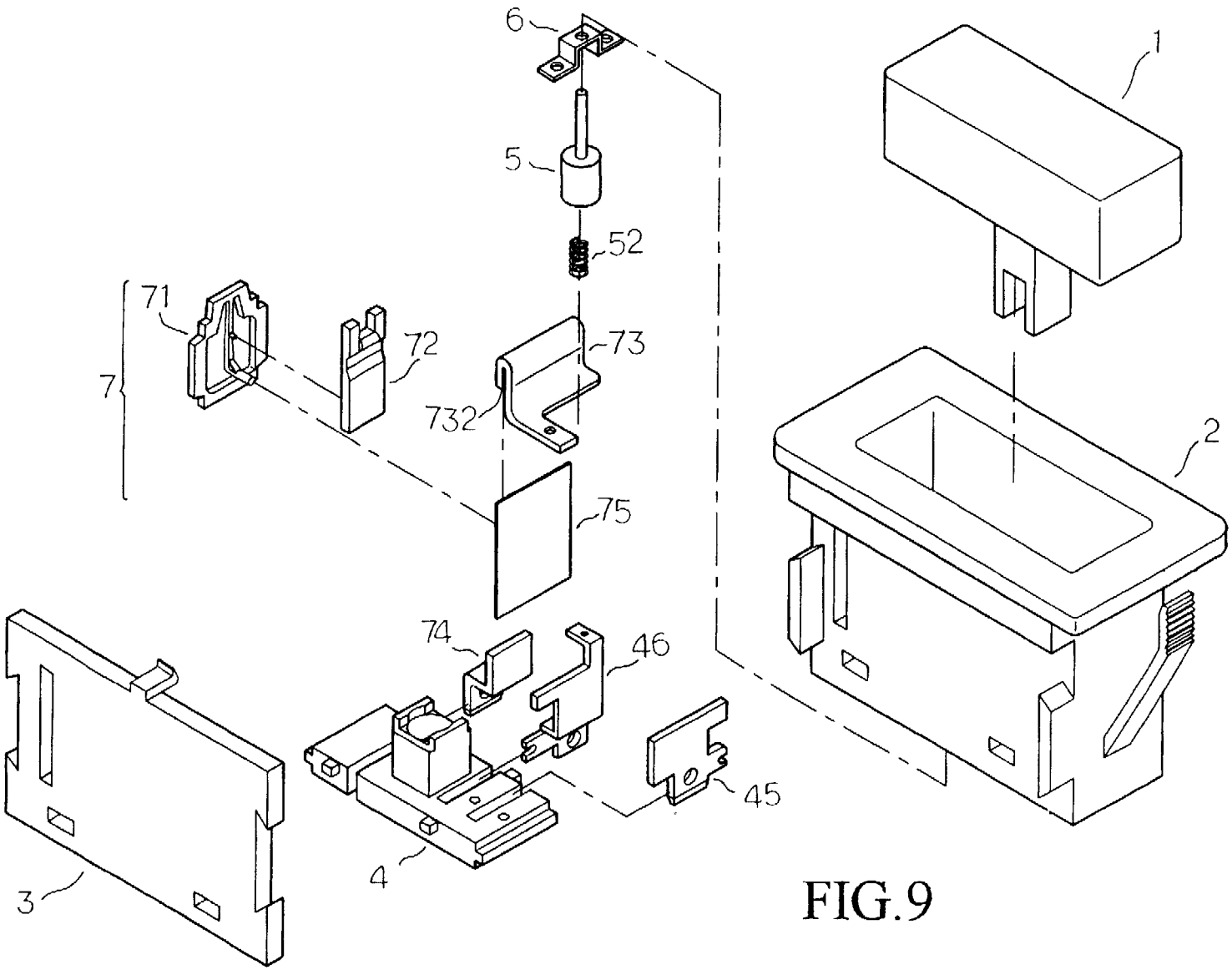
FIG. 9 is a perspective exploded view of another embodiment of the present invention.

FIG. 9 shows another embodiment of the present invention, in which the first conducting board 73 is formed with an insertion channel 732 for inserting one end of the bimetal blade 75 therein.

It should be noted that the above description and accompanying drawings are only used to illustrate some embodiments of the present invention, not intended to limit the scope thereof. Any modification of the embodiments should fall within the scope of the present invention.

What is claimed is:

1. A push button switch with override interruption switch, comprising:

a switch box;

a push button disposed at upper end of the switch box, a bottom of the push button being disposed with a pressing projection, whereby the push button can be depressed or moved upward to close or open a circuit;

a front cover disposed at front end of the switch box;

a base disposed at the bottom of the switch box and formed with a receptacle and multiple insertion channels for respectively inserting therein two conducting plates and a second conducting board;

a support rod having an upper end abutting against a lower end of the pressing projection of the push button and having a lower end fitted in the receptacle of the base, a restoring spring being disposed under the support rod for upward pushing the support rod;

an electric contact;

a second conducting board disposed with a second contact point; and an override interruption switch, said push button being characterized in that an override interruption structure is disposed with a first conducting board having a first contact point, one end of a bimetal blade being connected with the first conducting board, the other end of the bimetal blade being able to form a circuit together with the conducting plate inserted on the base, the override interruption switch being further disposed with a shaft seat and a power cutting member, whereby when the push button is depressed to close the circuit, the shaft seat is engaged with the power cutting member which is downward moved along with the push button, in the case of override, the bimetal blade being thermally deformed to act on the shaft seat so as to disengage from the power cutting member, whereby the power cutting member and the push button and electric contact are upward restored into a power cut state.

2. The push button as claimed in claim 1, wherein the shaft seat is formed with a central recess in which a restricting cantilever is disposed, a projection being disposed on an upper section of the restricting cantilever, the power cutting member being formed with a chamber corresponding to the projection, whereby when the power cutting member is moved up and down, the projection is moved within the chamber and temporarily engaged therewith.

3. The push button as claimed in claim 1, wherein the support rod has a hollow lower end for fitting into the receptacle of the base, the restoring spring being axially disposed between the hollow lower end of the support rod and the receptacle of the base.

4. The push button as claimed in claim 1, wherein the upper end of the support rod is disposed with a rod section and the electric contact is formed with a fitting hole corresponding to the rod section, whereby the electric contact can be fitted around the rod section.

5. The push button as claimed in claim 2, wherein the upper end of the support rod is disposed with a rod section and the electric contact is formed with a fitting hole corresponding to the rod section, whereby the electric contact can be fitted around the rod section.

6. The push button as claimed in claim 3, wherein the upper end of the support rod is disposed with a rod section and the electric contact is formed with a fitting hole corresponding to the rod section, whereby the electric contact can be fitted around the rod section.

7. The push button as claimed in claim 1, wherein one end of the first conducting board of the override interruption structure is formed with an insertion channel for inserting one end of the bimetal blade therein.

8. The push button as claimed in claim 1, wherein the other end of the bimetal blade is a free end connected with the conducting plate inserted in the base via a conducting wire to form a circuit.

9. The push button as claimed in claim 7, wherein the other end of the bimetal blade is a free end connected with the conducting plate inserted in the base via a conducting wire to form a circuit.

10. The push button as claimed in claim 1, wherein two sides of the switch box are disposed with engaging members for locking the switch box in an electric appliance.

* * * * *